US006581408B1

(12) United States Patent
Tadano et al.

(10) Patent No.: US 6,581,408 B1
(45) Date of Patent: Jun. 24, 2003

(54) MULTI-STAGE COMPRESSION REFRIGERATING DEVICE

(75) Inventors: Masaya Tadano, Moriguchi (JP); Atsushi Oda, Moriguchi (JP); Toshiyuki Ebara, Moriguchi (JP); Takashi Yamakawa, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/030,072

(22) PCT Filed: Sep. 25, 2000

(86) PCT No.: PCT/JP00/06586

§ 371 (c)(1),
(2), (4) Date: Jan. 10, 2002

(87) PCT Pub. No.: WO01/22009

PCT Pub. Date: Mar. 29, 2001

(30) Foreign Application Priority Data

Sep. 24, 1999 (JP) ..... 11-270905

(51) Int. Cl.[7] ..... F25B 41/00
(52) U.S. Cl. ..... 62/513; 62/199
(58) Field of Search ..... 62/199, 296, 504, 62/498, 505, 506, 508, 510, 513

(56) References Cited

U.S. PATENT DOCUMENTS

| | | | | |
|---|---|---|---|---|
| 4,594,858 A | | 6/1986 | Shaw | 62/175 |
| 4,696,168 A | * | 9/1987 | Woods et al. | 62/200 |
| 4,748,820 A | | 6/1988 | Shaw | 62/175 |
| 4,787,211 A | | 11/1988 | Shaw | 62/117 |
| 4,947,655 A | | 8/1990 | Shaw | 62/205 |
| 6,189,335 B1 | * | 2/2001 | Ebara et al. | 62/510 |

FOREIGN PATENT DOCUMENTS

| | | | | |
|---|---|---|---|---|
| GB | 2192735 A | * | 1/1988 | 62/513 |
| JP | 51-21338 | | 2/1976 | |
| JP | 63-25388 | | 2/1988 | |
| JP | 6-2965 | * | 1/1994 | 62/510 |
| JP | 6-229638 | * | 8/1994 | 62/510 |

OTHER PUBLICATIONS

International Search Report dated Dec. 26, 2000.
Microfilm of the specification and drawings annexed to the request of Japanese Utility Model Application No. 13303/1983 (Laid–open No. 118975/1984) (Mitsubishi Heavy Industries, Ltd.), Aug., 10, 1984.

* cited by examiner

*Primary Examiner*—Melvin Jones
(74) *Attorney, Agent, or Firm*—Armstrong, Westerman & Hattori, LLP

(57) ABSTRACT

Refrigerant exiting a condenser (1) is diverted into first and second parts, with the first part passed to a first intercooler (6) via a first decompression means (3) while the second part is passed to an evaporator (8) via a second decompression means (7). The refrigerant passed to the second decompression means (7) undergoes heat exchange with the intercooler (6). The refrigerant discharged from the evaporator (8) is fed to a first stage low-pressure compression means (32). In the multi-stage compression apparatus, the refrigerant discharged-from the low-pressure compression means (32) is mixed or merged with the refrigerant exiting the intercooler (6) at a merging point (106), and then fed to a second stage high-pressure compression means (34). The displacement volume of the low-pressure compression means (32) is larger than that of the high-pressure compression means(34). Provided between the first intercooler (6) and the merging point (106) is a one-way valve (9) for permitting the flow only in the direction from the first intercooler (6) to the merging point (106). The inventive multi-stage compression refrigeration apparatus may perform refrigeration with suppressed temperature of refrigerant gas discharged from the high pressure compression means (34). The apparatus can attain its stable normal operating condition in a short time. Thus, the inventive refrigeration apparatus has an improved refrigeration efficiency.

4 Claims, 5 Drawing Sheets

MULTI-STAGE COMPRESSION REFRIGERATING DEVICE

FIELD OF THE INVENTION

The invention relates to a multi-stage compression refrigeration apparatus having a multiplicity of compression means for compressing a refrigerant in multi-stages.

BACKGROUND OF THE INVENTION

A typical multi-stage compression refrigeration apparatus for use in a refrigerator and an air conditioner includes a rotary compressor consisting of a first and a second stage compression means which are housed in an enclosed container and each have a roller for compressing a refrigerant in the respective cylinder. The compressor performs compression of the refrigerant in two stages, first by the first stage compression means serving as a low-pressure compressor and then by the second stage compression means serving as a high-pressure compressor adapted to further compress the refrigerant gas compressed by the first stage low-pressure compressor.

Such a multi-stage compression refrigeration apparatus can attain a high compression ratio while suppressing variations of torque per one compression.

However, such multi-stage compressor has a drawback in that when a refrigerant has a high specific heat ratio, the second stage compression means has a low suction efficiency because it receives hot refrigerant heated by the first stage compression means. The multi-stage compressor also suffers from a further disadvantage that the temperature of the refrigerant is heated in the second stage high-pressure compression means to a great extent that the lubricant used therein will be thermally hydrolyzed into acids and alcohols, particularly when ester oil (for example, polyol ester, POE) is used. These acids disadvantageously develop sludges which tend to clog capillary tubes of the compressor, degrade the lubricant, and hence lower the performance of the apparatus.

In order to circumvent these problems, some compressors are provided with a cooling unit for cooling the refrigerant gas discharged from the first stage compression means before it is supplied to the second stage high-pressure compression means, thereby sufficiently lowering the temperature of the refrigerant gas discharged from the second stage compressor. For example, a known type of such multi-stage compression refrigeration apparatus as shown in FIG. 4 has: a multi-stage compressor 411 which consists of a first stage low-pressure compression means and a second stage high-pressure compression means; a condenser 412; a first decompression means 413, an intercooler 414, a second decompressor means 415, and an evaporator 416. The refrigerant exiting the condenser 412 is diverted into two parts, with one part passed to the intercooler 414 via the first decompression means 413, but the other part passed from the second decompression means 415 directly to the evaporator 416 so that the refrigerant flowing into the second decompression means 415 undergoes heat exchange with the intercooler 414. The refrigerant exiting the evaporator 416 is fed to the first stage compression means of the multi-stage compressor 411. On the other hand, the part of the refrigerant that has passed through the intercooler 414 is mixed with the refrigerant discharged from the first stage low-pressure compression means before entering the second stage compression means.

Thus, this multi-stage compression refrigeration apparatus has a refrigeration cycle as depicted in the P-h diagram (solid line) shown in FIG. 5. In this conventional apparatus, the enthalpy of the refrigerant is reduced by δHo, as shown in FIG. 5, by the heat exchange with the intercooler 414, so that the refrigerant is cooled before it flows into the second decompression means 415. Thus, this arrangement may increase an enthalpy difference across the evaporator 416.

However, in the conventional apparatus as mentioned above, the pressures of the refrigerant gas taken in the low-pressure and high-pressure compression means are almost the same (equilibrium pressure) during an early stage of startup. As a result, if the low-pressure compression means is larger in displacement volume than the high-pressure compression means, the amount, and hence the discharge pressure, of the refrigerant gas discharged from the former exceeds that of the latter compression means, thereby causing a backflow of the gas from the compressor to the intercooler 414.

The intercooler 414 is then heated by the backflow of refrigerant gas from the low-pressure compression means, which in turn results in a failure of adequate cooling of refrigerant fed to the second decompression means 415 by the intercooler 414. Hence, the apparatus disadvantageously takes time to attain supercooling to generate a large enthalpy difference δHo (shown in FIG. 5) that can be obtained under stable normal operation.

The invention is aimed to overcome these problems by providing an efficient multi-stage compression refrigeration apparatus which includes a first stage low-pressure compression means and a second stage high-pressure compression means. The apparatus comprises an intercooler for cooling the refrigerant gas discharged from the low-pressure compression means before it is fed to the high-pressure compression means, so that the refrigerant gas discharged from the high-pressure compression means has suppressed temperature. To shorten time for the apparatus to reach its stable operation following a startup, the apparatus is provided with a one-way valve to prevent backflow of the refrigerant gas from the first stage compression means to the intercooler.

DISCLOSURE OF THE INVENTION

In accordance with one embodiment of the invention, there is provided a multi-stage compression refrigeration apparatus including a compressor having a first stage low-pressure compression means and a second stage high-pressure compression means, a condenser, a first decompression means, a first intercooler, a second decompression means, and an evaporator. The refrigerant exiting the condenser is diverted into first and second parts, with the first part passed to the first intercooler via the first decompression means, while the second part is passed to the evaporator via the second decompression means and the first intercooler so that the refrigerant undergoes heat exchange with the first part in the first intercooler. The refrigerant exiting the evaporator is then fed to the first stage low-pressure compression means, and, when discharged from the first stage low-pressure compression means, mixed with the first part of the refrigerant exiting the first intercooler at a merging point upstream of the second stage high pressure compression means before the refrigerant is fed to the second stage compression means. The first stage low-pressure compression means has a larger displacement volume than the second stage high-pressure compression means. Between the first intercooler and the merging point, a one-way valve is provided to permit the refrigerant to flow only in the direction from the first intercooler to the merging point.

In this arrangement, the apparatus can: suppress sufficiently low the temperature of the refrigerant gas discharged from the second stage high pressure compression means; and prevent backflow of refrigerant from the first stage low pressure compression means to the first intercooler.

The apparatus may further comprise a second intercooler between the evaporator and the first stage low pressure compression means, which intercooler permits heat exchange between the first and the second parts of the refrigerant while passing through the second intercooler. This arrangement may create a larger enthalpy difference in the evaporator than conventional apparatuses during an early stage of startup.

The apparatus may have a third intercooler between the first intercooler and the merging point so that the refrigerant exiting the condenser undergoes heat exchange with the third intercooler, wherein the refrigerant exiting the third intercooler is passed through the one-way valve and fed to the second stage high pressure compression means together with the refrigerant discharged from the first stage low pressure compression means. This arrangement may advantageously enhance the above effects.

The refrigeration apparatus may further comprise a third decompression means for decompressing the second part of the diverted refrigerant after the refrigerant has undergone heat exchange with the second intercooler. The temperature of the refrigerant entering the evaporator is further lowered in this arrangement.

BEST MODE FOR CARRYING OUT THE INVENTION

The invention will now be described by way of example with reference to the accompanying drawings illustrating-an embodiment of a multi-stage compression refrigeration apparatus according to the invention.

Figure 2:
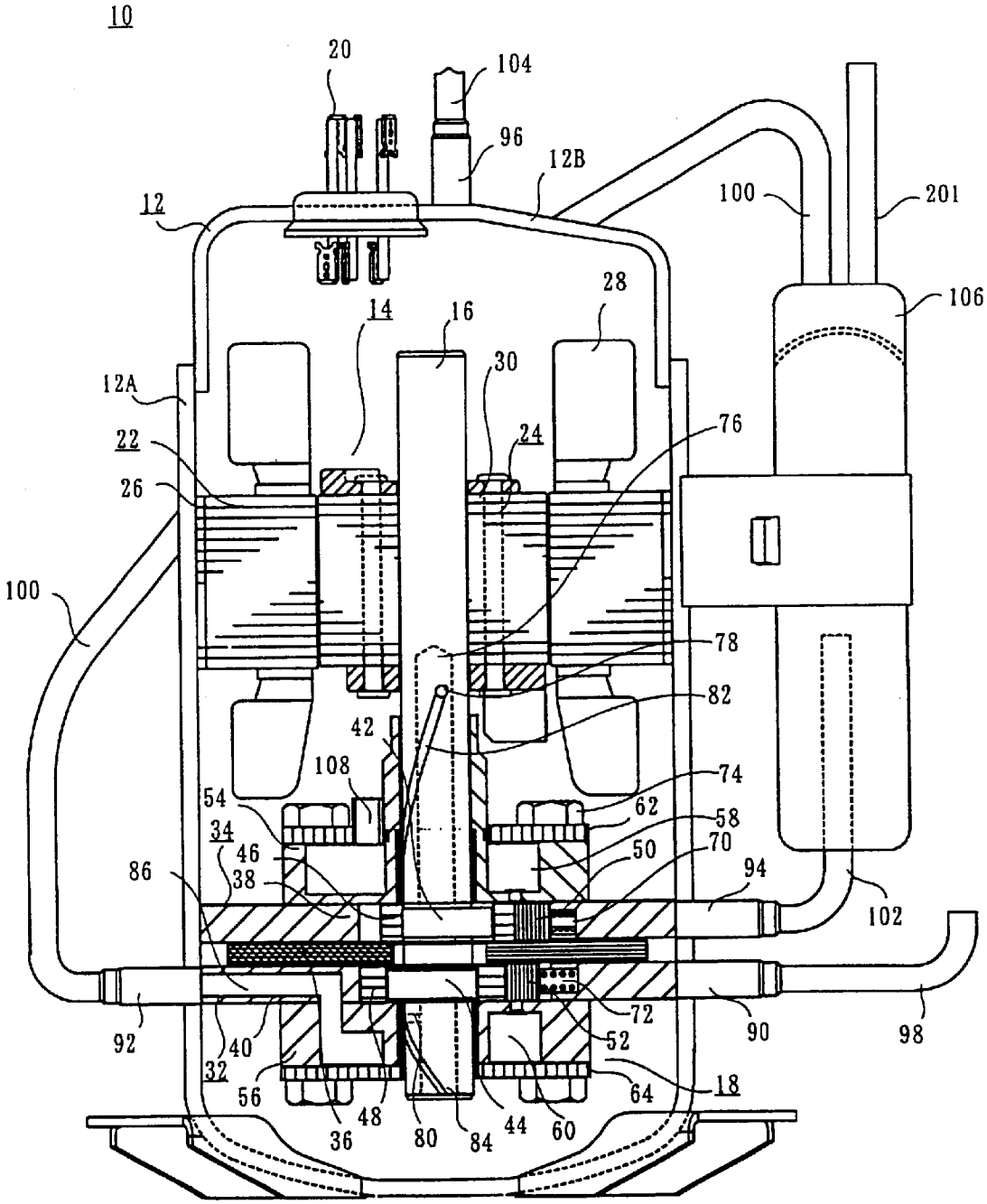
FIG. 2 shows a longitudinal cross section of the major section of a two-stage compression rotary compressor according to the invention.

As shown in FIG. 2, a multi-stage compression means of the invention in the form of two-stage compression rotary compressor 10 has a generally cylindrical enclosed steel container 12, an electric motor 14 installed in an upper space of the container 12, and a compression element in the form of rotary compression mechanism 18 which is installed in a space below the electric motor 14 and operatively connected with the electric motor 14 by a crank shaft 16.

The container 12 has an oil sump at the bottom thereof, and consists of a container body 12A for accommodating the electric motor 14 and the rotary compression mechanism 18, and a cover member 12B for closing an upper opening formed in the container body 12A. The cover member 12B has a set of terminals (lead wires not shown) 20 for supplying the electric motor 14 with electric power from an external power source.

The electric motor 14 has a stator 22 toroidally mounted on the inner surface of the enclosed container 12, and a rotor 24 mounted inside the stator 22 with a little gap between them. The rotor 24 may be integral with the crank shaft 16 vertically extending through the center of the rotor.

The stator 22 includes a stack 26 of electromagnetically susceptible annular steel plates, and a multiplicity of coils 28 wound on the stack 26. Like the stator 22, the rotor 24 is also composed of a stack 30 of a multiplicity of electromagnetically susceptible steel plates. In the example shown herein, the electric motor 14 is an AC motor, which can be replaced by a DC motor having permanent magnets.

The rotary compression mechanism 18 includes a first stage low-pressure compression element 32 serving as a low-pressure compression means, and a second stage high-pressure compression element 34 serving as a high-pressure compression means. Specifically, the rotary compression mechanism 18 consists of an intermediate partition panel 36; upper and lower cylinders 38 and 40, respectively, provided above and below the intermediate partition panel 36; upper and lower rollers 46 and 48, respectively, connected with respective upper and lower eccentric members 42 and 44 which are mounted on the crank shaft 16 for rotation inside the upper and lower cylinders 38 and 40; upper and lower vanes 50 and 52, respectively, in contact with the respective upper and lower rollers 46 and 48, for partitioning the respective spaces of the upper and lower cylinders 38 and 40 into respective suction chambers (inlet sides of the spaces) and compression chambers (outlet sides of the spaces); and upper and lower support members 54 and 56, respectively, for bearing the crank shaft 16 and for closing the openings of the respective upper and lower cylinders 38 and 40.

Provided above and below the respective upper and lower support members 54 and 56 are discharge sound silencer chambers 58 and 60 formed to appropriately communicate with the upper and the lower cylinders 38 and 40, respectively, via valve means (not shown). The openings of these discharge sound silencers are closed by upper and lower plates 62 and 64, respectively.

The upper and lower vanes 50 and 52, respectively, are sidably mounted in the respective radial guide grooves (not shown) formed in the cylinder walls of the upper and lower cylinders 38 and 40, and biased by respective springs 70 and 72 to always abut on the respective upper and lower rollers 46 and 48.

In the lower cylinder 40, first stage (low-pressure) compression is performed, while in the upper cylinder 38 second stage (higher pressure) compression of the refrigerant gas is performed.

In the example shown herein, the upper support member 54, the upper cylinder 38, the intermediate partition panel 36, the lower cylinder 40, and the lower support member 56 are placed in the order mentioned and sandwiched by the upper and the lower plates 62 and 64, respectively, and securely fixed by a multiplicity of mounting bolts 74 to all together constitute the rotary compression mechanism 18.

Formed through the shaft 16 is a straight oiling bore 76, which communicates with spiral oiling grooves 82 and 84 via transverse oiling bores 78 and 80 to supply oil to the respective bearings and to those members in sliding contact.

In the embodiment shown herein, refrigerant R404A is used. The lubricant can be any of conventional lubricants such as mineral oils, alkylbenzen oils, polyalkylene glycol (PAG) oils, ether oils, and ester oils.

The first stage low-pressure compression element 32 of the above described rotary compression mechanism 18 is designed to operate at inlet refrigerant pressure of 0.05 MPa and discharge refrigerant pressure of 0.18 MPa. The second stage high-pressure compression element 34 operates at inlet refrigerant pressure of 0.18 MPa, and discharge refrigerant pressure of 1.90 MPa. The displacement volume D1 of the low-pressure compression element 32 is made larger than that D2 of the high-pressure compression element 34. In an embodiment shown herein the ratio D2/D1 is in the ranges about from 9 to 39%. With this ratio of the displacement volumes, the coefficient of performance, and hence efficiency, of the apparatus is improved when the evaporator has evaporation temperature in the range from −50° C. to −70° C.

The upper and lower cylinders 38 and 40 are provided with upper and lower refrigerant suction passages (not shown) for introducing the refrigerant, and with a discharge passage 86 for discharging the compressed refrigerant via the discharge sound silencer chambers 58 and 60. Each of the refrigerant suction passages and refrigerant discharge passage 86 are connected with respective refrigerant lines 98, 100, and 102 via connection tubes 90, 92, and 94 which are secured to the enclosed container 12. Connected between the refrigerant lines 100 and 102 is a suction muffler 106 working as a liquid-gas separator.

In the suction muffler 106, the refrigerant from the line 100 merges with the refrigerant from a refrigerant line 201 connected with a third intercooler (not shown) mounted outside the compressor 10, as described later.

In addition, the upper support plate 62 is provided thereon with a discharge tube 108 for communicating the discharge sound silencer chamber 58 of the upper support member 54 with the inner space of the enclosed container 12. A vapor compression type refrigeration cycle is established in the apparatus as follows. The refrigerant gas of the second stage high-pressure compression element 34 is discharged directly into the enclosed container 12, thereby rendering the container 12 to maintain a high inner pressure. The gas is then lead to an external condenser (not shown) via a connection tube 96 secured to the upper cover 12B and a refrigerant line 104 connected to the connection tube 96. The refrigerant circulates through the refrigerant circuit as described below, and returns to the first stage low-pressure compression element 32 via the refrigerant line 98, connection tube 90 and the upper refrigerant suction passage of the upper cylinder 38.

It is noted that a smaller clearance is provided for the components in the first stage low-pressure compression element 32 than that in the second stage high-pressure compression element 34. For example, the clearance is about 10 micrometers in the first stage lower pressure element 32, while the clearance is about 20 micrometers in the second stage high-pressure compression element 34. Thus, the higher pressure refrigerant gas in the container 12 is prevented from leaking into the first stage compression element 32 containing the refrigerant gas at a much lower pressure, thereby improving volumetric efficiency and compression efficiency of the compressor.

Next, referring to FIG. 1, the operation of the multi-stage compression refrigeration apparatus equipped with a two-stage compression rotary compressor 10 of the invention will be described.

Figure 1:
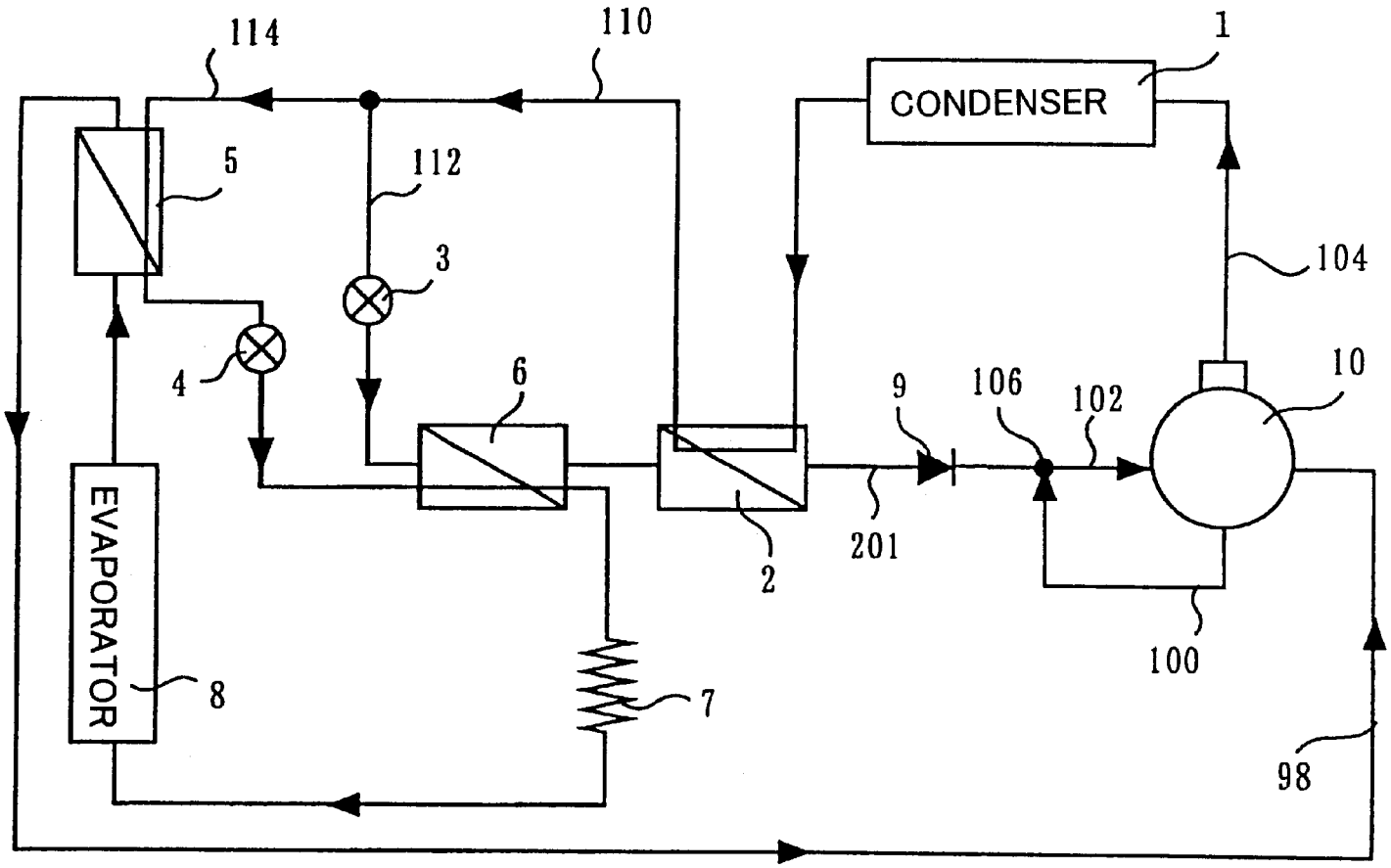
FIG. 1 shows a refrigerant circuit of a preferred multi-stage compression refrigeration apparatus embodying the invention.

As the high-pressure refrigerant is discharged from the two-stage compression rotary compressor 10, it flows into a condenser 1 via a refrigerant line 104, as shown in FIG. 1. The refrigerant is condensed in the condenser 1 and passed through the refrigerant line 110, which refrigerant undergoes heat exchange with a third intercooler 2, as described later. The refrigerant line 110 is bifurcated into two refrigerant lines 112 and 114 to divert the refrigerant into first and second parts, respectively.

A first expansion valve 3 is provided in the bifurcated line 112 to serve as a means for decompressing the first part of the refrigerant passing through the line 112.

A second expansion valve 4 is provided in the other bifurcated line 114 to serve as a third decompressing means for decompressing the second part of the refrigerant passing therethrough. The refrigerant flowing through the line 114 is passed to the second intercooler 5 where it undergoes heat exchange with the refrigerant discharged from the evaporator 8. The refrigerant is then led to the second expansion valve 4.

Connected to the discharge end of the first expansion valve 3 is a first intercooler 6 permitting the refrigerant to undergo heat exchange with the refrigerant decompressed by the second expansion valve 4. The third intercooler 2 is connected at the outlet end of the first intercooler 6.

The refrigerant discharged from the third intercooler 2 flows into the suction muffler 106 via the refrigerant line 201, where the refrigerant is mixed with the refrigerant discharged thereinto from the first stage low-pressure compression element 32 via the refrigerant line 100.

Provided in the refrigerant line 201 connecting the third intercooler 2 to the suction muffler 106 serving as the merging point is a one-way valve 9 for permitting the refrigerant to flow only in the direction from the third intercooler 2 to the merging point. Provision of the one-way valve prevents backflow of refrigerant gas discharged from the low-pressure compression element 32 to the first intercooler 6, which in turn prevents heating of the first intercooler 6 and the third intercooler 2 by the backflow, thereby shortening time to reach the stationary supercooling after resumption of the refrigeration.

The refrigerant gas discharged from the suction muffler 106 is fed to the second stage high-pressure compression element 34 by the refrigeration line 102.

The tube 7 is a capillary tube serving as the second decompression means for decompressing the refrigerant discharged from the second expansion valve 4 to the first intercooler 6 for heat exchange. The refrigerant discharged from the capillary tube 7 is supplied to the evaporator 8, where it is heated by the ambient air to evaporate. Connected to the outlet of the evaporator 8 is the second intercooler 5, where the refrigerant undergoes heat exchange with refrigerant passing through the refrigerant line 114. The refrigerant is then passed, via the refrigerant line 98, to the connection tube 90 of the first stage low-pressure compression element 32 of the two-stage compression rotary compressor 10.

This completes the refrigeration cycle of the multi-stage compression refrigeration apparatus of the invention.

The first intercooler 6, second intercooler 5, and third intercooler 2 absorb heat from their surroundings to perform required refrigeration. The heat exchanger of these intercoolers will be hereinafter referred to as the first, second, and third supercooling sections, respectively.

Figure 4:
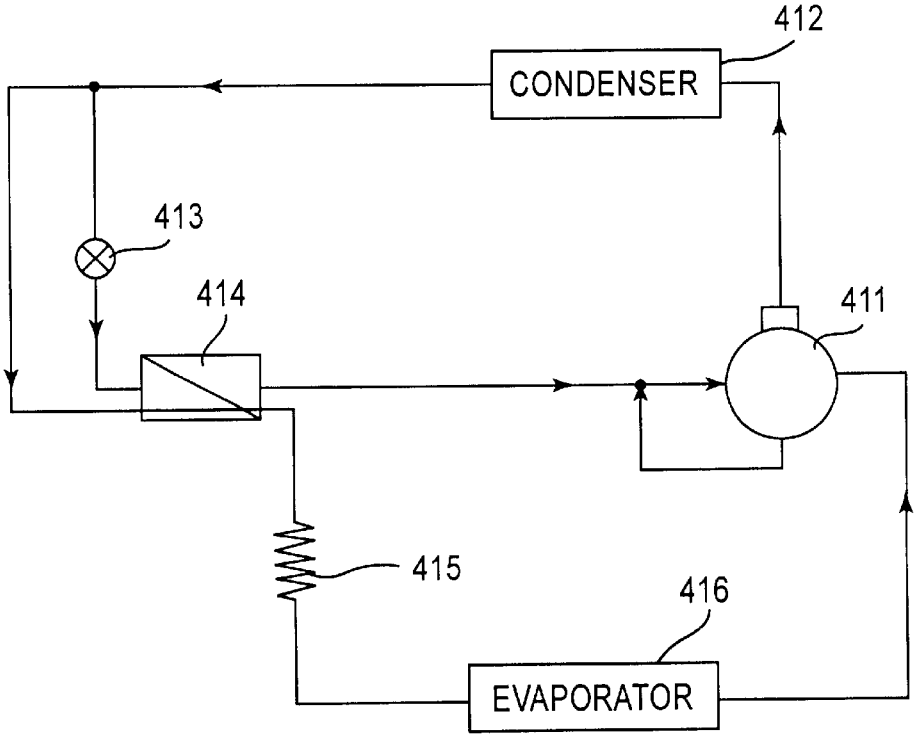
FIG.4 PRIOR ART
FIG. 4 shows a refrigerant circuit of a conventional multi-stage compression refrigeration apparatus.
Figure 5:
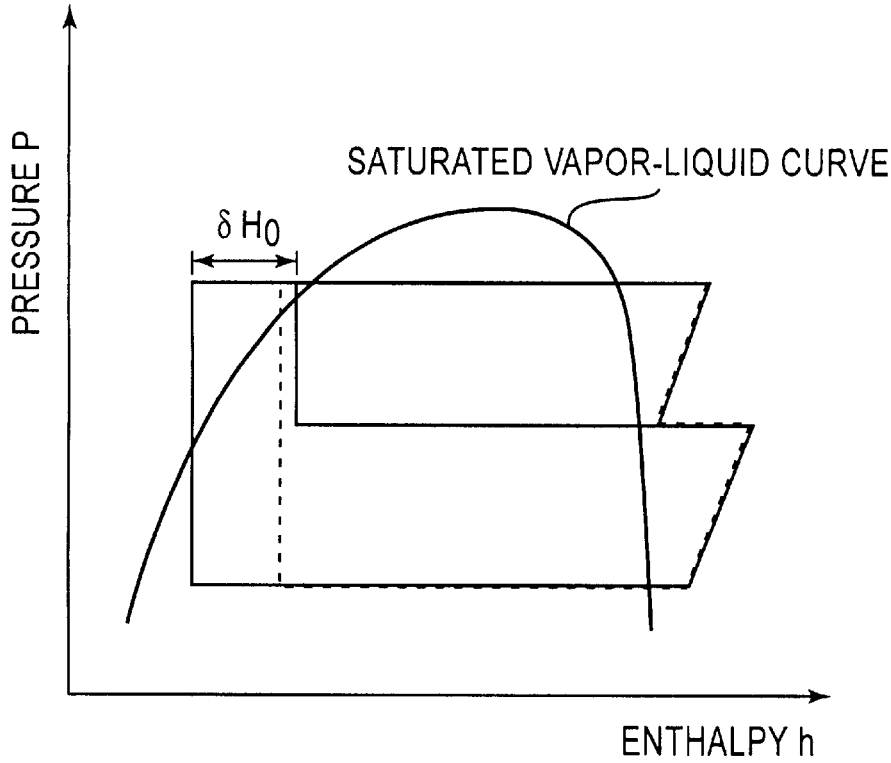
FIG.5 PRIOR ART
FIG. 5 shows a P-h diagram of a conventional multi-stage compression refrigeration apparatus.

The reason for distributing supercoolers at different positions is to resolve a problem pertinent to conventional apparatuses as shown in FIG. 4, that is, without these intercoolers the refrigerant flowing in the second decompression means 415 is not sufficiently cooled.solely by the intercooler 414 during an early stage of startup due to the sensible heat in the tubes of the intercooler 414, so that the evaporator cannot create enthalpy difference δHo required for a normal operation (as indicated in FIG. 5).

In the description given above, the refrigerant is supercooled once in the second supercooling section and then passed to the first supercooling section via the second expansion valve 4. This is based on our finding that the heat transfer efficiency is improved by subjecting the refrigerant to supercooling once before expansion and once after expansion by a decompressor.

Figure 3:
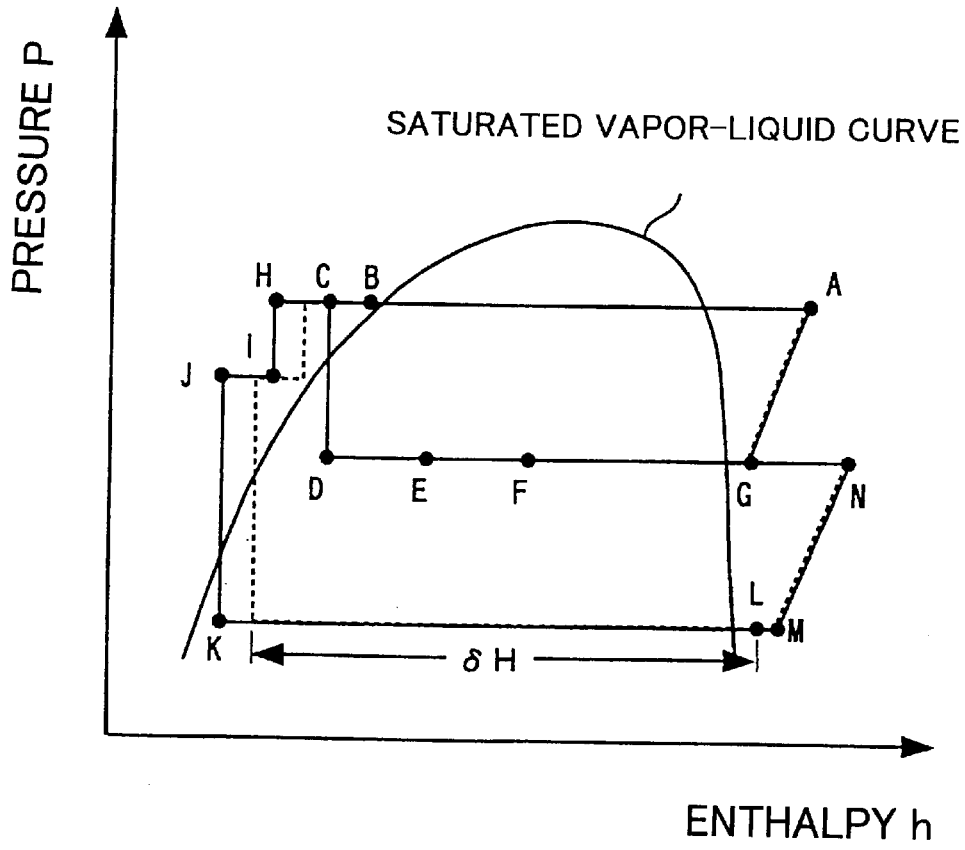
FIG. 3 is a P-h diagram of a multi-stage compression refrigeration apparatus of the invention.

Thermodynamic conditions of the refrigerant during a refrigeration cycle as described above will now be described with reference to FIG. 3 showing the P-h diagram. In this figure, a change in thermodynamic state of the refrigerant during a normal operation of the apparatus is illustrated by a solid line, while the change in state of the refrigerant during an early stage of startup is illustrated by a broken line.

In FIG. 3, point A represents the state of the refrigerant discharged from the second stage high-pressure compression element 34 of the two-stage compression rotary compressor 10. The refrigerant undergoes a change from point A to point B when condensed by the condenser 1. Thereafter, the refrigerant is cooled to point C by the heat exchange with the third supercooling section (i.e. the third intercooler 2). At point C, the refrigerant is diverted, with one part decompressed by the first expansion valve 3, and passed to the first intercooler 6 after the pressure is lowered to point D.

The other part diverted at point C is cooled to point H by the heat exchange with the second intercooler 5 connected with the discharge port of evaporator 8 in the second supercooling section, and further decompressed to point I by the second expansion valve 4. In the first supercooling section, the refrigerant undergoes heat exchange at point I with the first intercooler 6, reaching point J. On the other hand, the refrigerant at point D changes its state to point E at the discharge port of the first intercooler 6.

Point F represents the state of the first part of the refrigerant after it has exited the first intercooler 6 and undergone heat exchange in the third intercooler 2 with the refrigerant which has been condensed to state B by the condenser 1 and passed to the third intercooler 2.

The refrigerant is decompressed at point J down to point K by the capillary tube 7 before the refrigerant flows into the evaporator 8. The refrigerant evaporated (at point L) in the evaporator 8 is supercooled, changing its state to point M at the outlet of the second intercooler 5, and then is allowed to flow into the first stage low-pressure compression element 32 of the compressor 10.

The hot and high-pressure refrigerant, now compressed to point N in the first stage low-pressure compression element 32 is led to the suction muffler 106, where the refrigerant is mixed with the part of the refrigerant discharged from a third intercooler 2 (and having a state represented by point F). The mixed refrigerant is cooled to point G. The refrigerant (cooled to point G) is fed to the second stage high-pressure compression element 34 of the two-stage compression rotary compressor 10 for second stage compression (point A) and discharged to the condenser 1.

It is noted that in this way the refrigerant discharged from the condenser 1 can be supercooled in the third supercooling section, and that the second part of the refrigerant passing through the capillary tube 7 and evaporator 8 can be supercooled in the first- and the second-supercooling sections.

It is also noted that sensible heat of supercooling sections can be minimized by providing distributed supercooling sections each having a limited heat capacity. Thus, unlike conventional apparatuses, it is possible to allow supercooling even in an early stage of startup of the apparatus (FIG. 3, broken line) to increase enthalpy difference δH in the evaporator 8.

In particular, it would be appreciated that provision of the second supercooling section 5, in addition to the first supercooling section 6, ensures sufficient supercooling of the second part of the refrigerant passing through the capillary tube 7 in a short time subsequent to a startup through heat exchange with the cold refrigerant discharged from the evaporator 8.

The invention has been described in conjunction with preferred embodiments, which are intended to be illustrative of the invention defined in the claims rather than limiting the invention defined by the appended claims. Variations and modifications of the present invention can be effected within the scope of the invention.

For example, instead of a high-pressure type container 12 for maintaining highly pressurized refrigerant, a low-pressure type container for maintaining refrigerant at a low pressure in substantial equilibrium with refrigerant at the inlet port of the first stage low-pressure compression element 32, and an intermediate pressure type container for maintaining the refrigerant at an intermediate pressure in substantial equilibrium with the refrigerant at the outlet port of the first stage low-pressure compression element 32 can be utilized.

In the example shown herein, an embodiment is shown to have first, second, and third supercooling sections. However, the inventive compressor is not limited to this type. For example, the invention may be applied to a conventional compression apparatus (FIG. 4) having a single intercooler for supercooling.

INDUSTRIAL UTILITY

In accordance with the invention, refrigerant compressed in and discharged from a first stage low-pressure compressor is further cooled to suppress the temperature of the refrigerant discharged from the high-pressure compressor, and the backflow of the refrigerant gas from the first stage low-pressure compression means to the intercooler is prevented. Thus, an inventive multi-stage compression refrigeration apparatus requires only a short time to reach its stable normal operating condition following a startup, exhibiting an improved refrigeration efficiency.

What is claimed is:

1. A multi-stage compression refrigeration apparatus having a compressor including a first stage low-pressure compression means and a second stage high-pressure compression means, a condenser, a first decompression means, a first intercooler, a second decompression means, and an evaporator, wherein the refrigerant exiting said condenser diverted into a first and a second parts, with said first part passed to said first intercooler via said first decompression means while said second part is passed to said evaporator via said second decompression means and said first intercooler so that the refrigerant undergoes heat exchange with said first part in said first intercooler, and then the refrigerant exiting said evaporator is fed to said first stage low-pressure compression means, and, when discharged from said first stage low-pressure compression means, mixed with said first part of the refrigerant exiting said first intercooler at a merging point upstream of said second stage high pressure compression means before the refrigerant is fed to said second stage compression means, and wherein said first stage low-pressure compression means has a larger displacement volume than said second stage high-pressure compression means; and wherein between said first intercooler and said merging point, a one-way valve is provided which permits the refrigerant to flow only in the direction from said first intercooler to said merging point.

2. The refrigeration apparatus according to claim 1, further comprising a second intercooler between said evaporator and said first stage low pressure compression means, which intercooler permits heat exchange between said first and second parts of the refrigerant while passing through said second intercooler.

3. The refrigeration apparatus according to claim 2, further comprising a third intercooler between said first intercooler and said merging point so that the refrigerant exiting said condenser undergoes heat exchange with said third intercooler, wherein the refrigerant exiting said third intercooler is passed through said one-way valve and fed to said second stage high pressure compression means together with the refrigerant discharged from said first stage low pressure compression means.

4. The refrigeration apparatus according to claim 2 or claim 3, further comprising a third decompression means for decompressing said second part of said diverted refrigerant after the refrigerant has undergone heat exchange with said second intercooler.

* * * * *